US005370577A

United States Patent [19]

Jonett et al.

[11] Patent Number: 5,370,577

[45] Date of Patent: Dec. 6, 1994

[54] INTEGRAL MULTI-FUNCTIONAL APPARATUS USED WITH A BUILDING TRUSS

[75] Inventors: Mike Jonett, 721 S. Kiowa Rd., Bennett, Colo. 80102; Ronald Barnes, Bennett, Colo.

[73] Assignee: Mike Jonett, Bennett, Colo.

[21] Appl. No.: 146,226

[22] Filed: Nov. 1, 1993

[51] Int. Cl.[5] ..... F24F 7/02

[52] U.S. Cl. ..... 454/260; 52/95

[58] Field of Search ..... 52/95; 454/260

[56] References Cited

U.S. PATENT DOCUMENTS

| | | | |
|---|---|---|---|
| 1,651,071 | 11/1927 | Scheppers | 454/260 X |
| 2,969,726 | 1/1961 | Bottom | 454/260 |
| 3,777,649 | 12/1973 | Luckey | 454/260 |
| 3,863,553 | 2/1975 | Koontz | 454/260 |
| 4,007,672 | 2/1977 | Luckey | 454/260 |
| 4,126,973 | 11/1978 | Luckey | 454/260 X |
| 4,184,416 | 1/1980 | Koontz | 454/260 |
| 4,669,235 | 6/1987 | Reinen | 52/98 |
| 4,714,372 | 12/1987 | Commins | 403/400 |
| 5,007,216 | 4/1991 | Pearson | 454/260 X |
| 5,185,974 | 2/1993 | Diehl | 454/260 X |

*Primary Examiner*—Harold Joyce
*Attorney, Agent, or Firm*—Sheridan Ross & McIntosh

[57] ABSTRACT

An integral multi-functional apparatus is used with building trusses which provides structural integrity in the horizontal and vertical dimensions. The apparatus also serves to permit ventilation and maintain insulation in a desired position. Each apparatus includes a face plate having a plurality of air passages, a back plate having a lip, opposing stud straps for vertical interconnection of truss chords with the frame, and opposing truss chord flanges for horizontal interconnection of the truss chords. A top truss chord web is joined to each truss chord flange for securement to the top of the truss chord. A top plate tab is also joined to each truss chord flange for attachment to the top plate of the frame.

19 Claims, 5 Drawing Sheets

INTEGRAL MULTI-FUNCTIONAL APPARATUS USED WITH A BUILDING TRUSS

FIELD OF THE INVENTION

The present invention relates generally to construction hardware. More particularly, the present invention relates to construction members for installation between adjacent roof truss chords of a building for providing desired spacing between chords, ventilation within the interior of the roof, insulation retainers, and for securing together a plurality of roof members, including truss chords, a top plate and studs covered with sheathing, to enhance the structural integrity of the building.

BACKGROUND OF THE INVENTION

In constructing wood framed buildings, and especially in residential construction, it is common to use trusses to support the roof. Trusses are typically triangular in shape and are positioned on, and secured to, the top plate of the frame directly above the vertically extending studs. Top plates typically include upper and lower boards or members.

A variety of techniques and products have been developed for use in this environment. With respect to securing the truss to the frame it is known in the art to guard against the uplifting or removal of the roof from the structure by using hurricane clips or similar hardware, such as straps, to connect truss members to the frame of the building. Hurricane clips typically are metal clips secured to one truss member and to the frame of the house with nails or other fasteners.

The use of ventilation devices and insulation stops is also known in the practice of building construction. Ventilation devices are typically disposed between adjacent roof trusses and immediately above the top plate. Ventilation devices allow a free flow of air to cool the attic space in the summer and to restrict moisture buildup during the winter. Insulation stops are known to be used with ventilation devices to prevent unwanted movement of insulation.

Also known in the art are spacing and support construction members which provide proper spacing between adjacent roof members and which support adjacent roof members by providing physical linkage between adjacent roof members and between roof members and the support structure, otherwise known as bridging.

SUMMARY OF THE INVENTION

A system is disclosed for providing interconnection of roof truss members or chords in both the vertical and the horizontal dimensions. A key feature of the disclosed system is the interconnection of a number of apparatuses of the present invention, as well as the connection of these apparatuses to the structural parts of the building. Preferably, each apparatus is a single, unitary member which provides both the vertical and horizontal connections between truss members, together with walls of the structure. Each apparatus has a predetermined length to provide proper spacing between truss chords. The face plate of the apparatus has ventilation holes for permitting the passage of air within the roof interior. An insulation retainer is joined to the face plate to control the positioning of batt insulation. Each apparatus has a number of interconnectors including flanges, webs, straps and tabs for attachment to the building structure. Webs and straps of adjacent apparatuses are joined together using fasteners to provide the linking relationship among apparatuses. As a result, the apparatus of the present invention yields substantial efficiencies in the construction of buildings using roof trusses or rafters and ceiling joists, as well improved structural integrity of those buildings.

DETAILED DESCRIPTION

Figure 1:
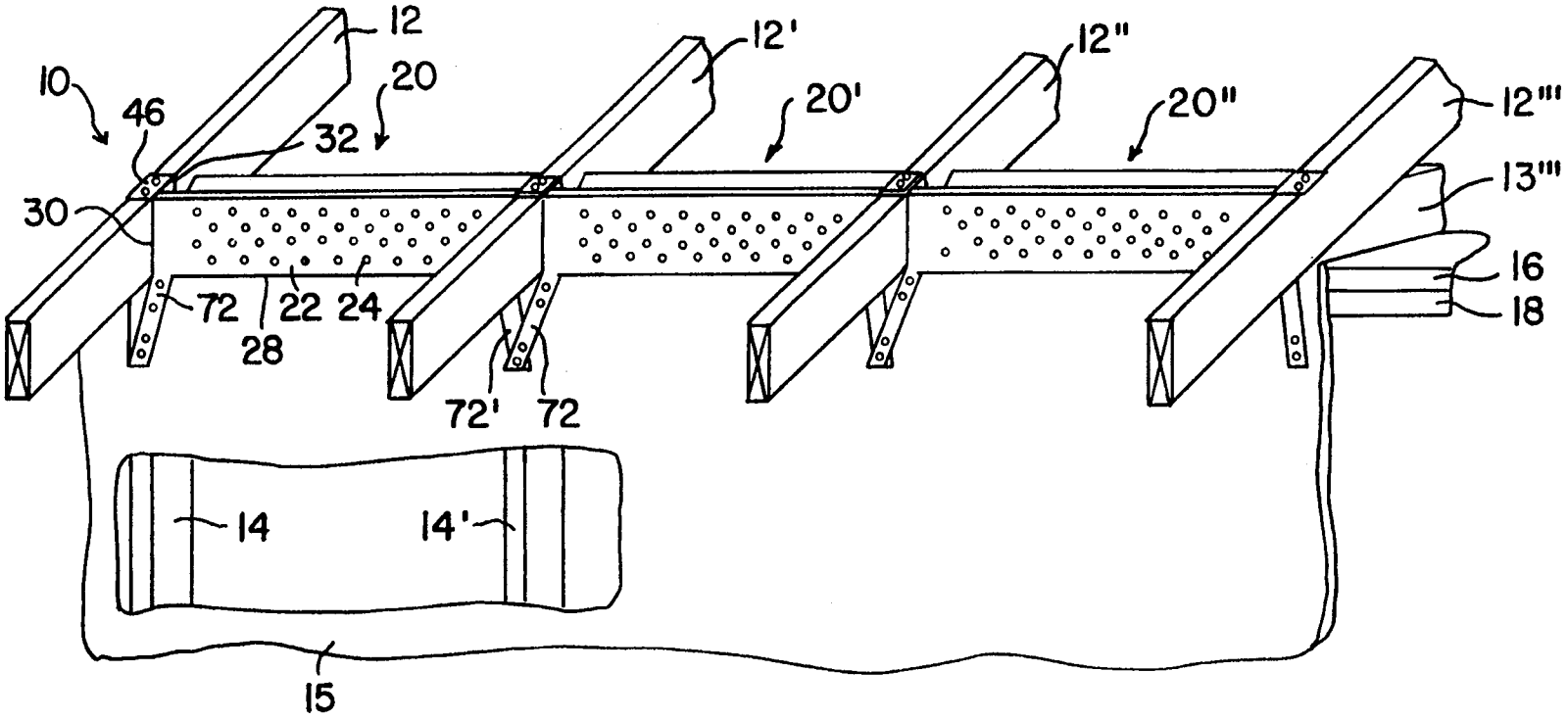
FIG. 1 is a frontal perspective view of a system including three interconnected apparatuses.
Figure 2:
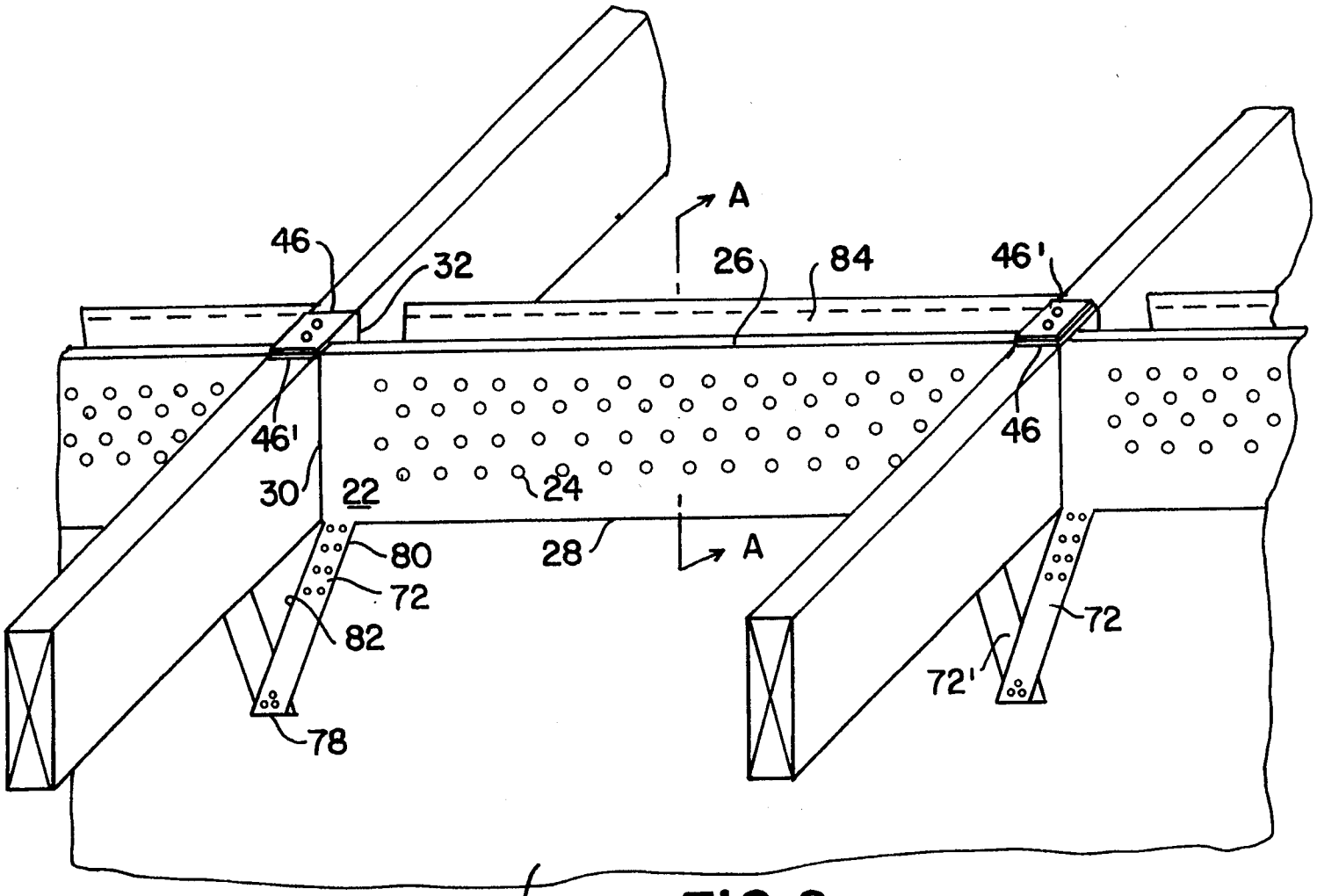
FIG. 2 is a frontal perspective view illustrating the interconnection between two adjacent top truss chord members and three apparatuses.

With reference to FIGS. 1 and 2, the system 10 of the present invention is used to interconnect common construction members including a truss having a plurality of top chords 12 and bottom chords 13, a plurality of vertical studs, 14 supporting sheathing 15, commonly made of plywood, and a top plate comprising a top member 16 and a bottom member 18. The system 10 includes a plurality of interconnected apparatuses 20. Each element of the disclosed system 10 is described with particularity below. However, it should be appreciated that the present invention encompasses other embodiments which provide equivalent functions.

In the embodiment illustrated in FIG. 1, three apparatuses 20, 20', 20'' are depicted as being directly interconnected, although it should be appreciated that the number of interconnected apparatuses 20 depends upon the number of truss chords used in the particular building. Each apparatus 20, 20', 20'' is substantially symmetrical about a vertical plane A—A which bisects the apparatus 20 at its midpoint as illustrated in FIG. 2. Each apparatus 20 includes a substantially vertically disposed face plate 22 having a plurality of ventilation holes 24 which allow air to flow freely through the plane of the face plate 22. The face plate 22 includes an upper rib 26, a lower side 28 (FIG. 2) and first and second side edges 30 (FIG. 2), 30' (FIG. 3).

Figure 3:
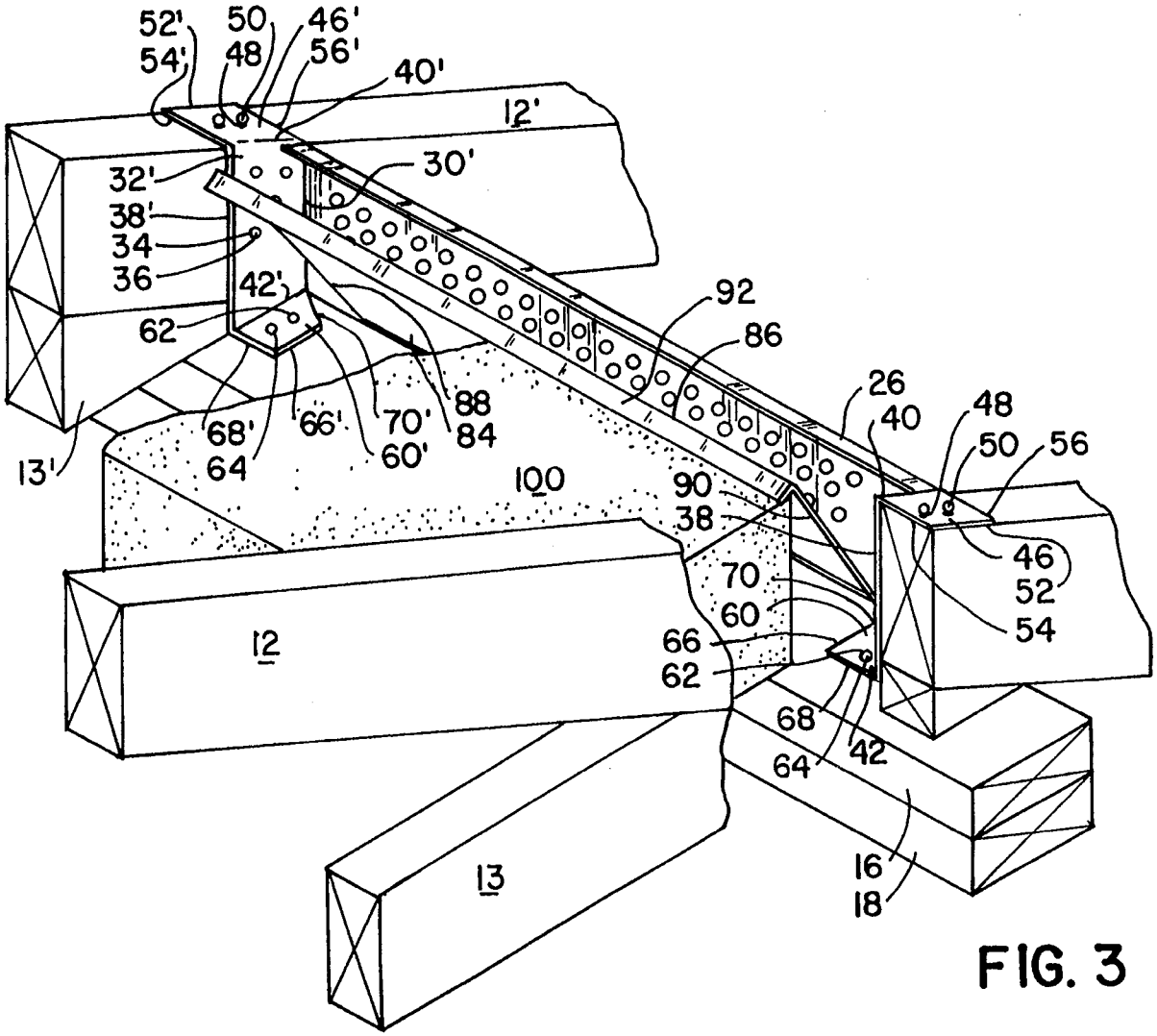
FIG. 3 is a rear perspective view illustrating the use of a back plate as an insulation retainer.
Figure 5:
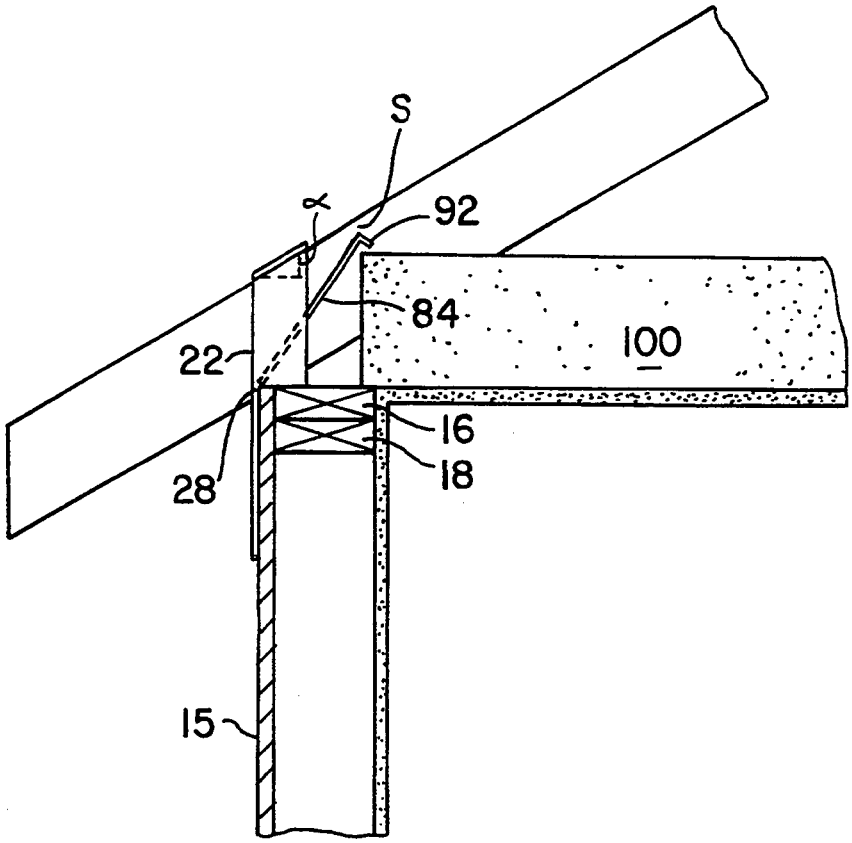
FIG. 5 is a side elevation view illustrating the use of a back plate having an insulation lip as an insulation retainer.

As seen in FIGS. 2 and 3, first and second side truss chord flanges 32, 32' are joined to the face plate 22 along the first and second side edges 30, 30'. First and second truss chord flanges 32, 32' are substantially vertically disposed in a plane which is orthogonal to the face plate 22. First and second truss chord flanges 32, 32' include a plurality of openings 34 through which truss chord flange connectors 36 may be inserted. Each truss chord flange 32, 32' is a quadrilateral member having a first side edge 30, 30' in common with the face plate 22 a second side edge 38, 38', an upper edge 40, 40' and a lower edge 42, 42'. The lower edge 42, 42' of each truss chord flange 32, 32' is disposed in a substantially horizontal plane. The upper edge 40, 40' is disposed in a plane which rises from the first side edge 30, 30' at an acute angle $\alpha$, as illustrated in FIG. 5.

First and second top chord truss webs 46, 46' are joined to the upper edges 40, 40' of first and second truss chord flanges 32, 32', respectively. Each top chord truss web 46, 46′ is disposed substantially orthogonally relative to first and second truss chord flanges 32, 32′. Each top chord truss web 46, 46′ includes a plurality of holes 48 through which truss chord web connectors 50 are inserted, with adjacent webs overlapping each other before the connectors, such as nails, are driven through the holes to interconnect the adjacent webs. Each top truss chord web 46, 46′ is in the shape of a parallelogram having a first side edge defined by the upper edge 40, 40′ of the truss chord flange 32, 32′, a second side edge 52, 52′, an upper edge 54, 54′ and a lower edge 56, 56′.

First and second top plate tabs 60, 60′ are joined to the lower edges 42, 42′of the first and second truss chord flanges 32, 32′, respectively. Each top plate tab 60, 60′ is substantially horizontally disposed in a plane which is orthogonal relative to first and second truss chord flanges 32, 32′. Each top plate tab 60, 60′ includes a plurality of openings 62 through which top plate connectors 64 are inserted. Each top plate tab 60, 60′ is a quadrilateral member having a first side edge defined by the lower edge 42, 42′ of the adjoining truss chord flange 32, 32′ a second side edge 66, 66′ substantially parallel to the first side edge, a third side edge 68, 68′ and a fourth side edge 70, 70′.

Figure 4:
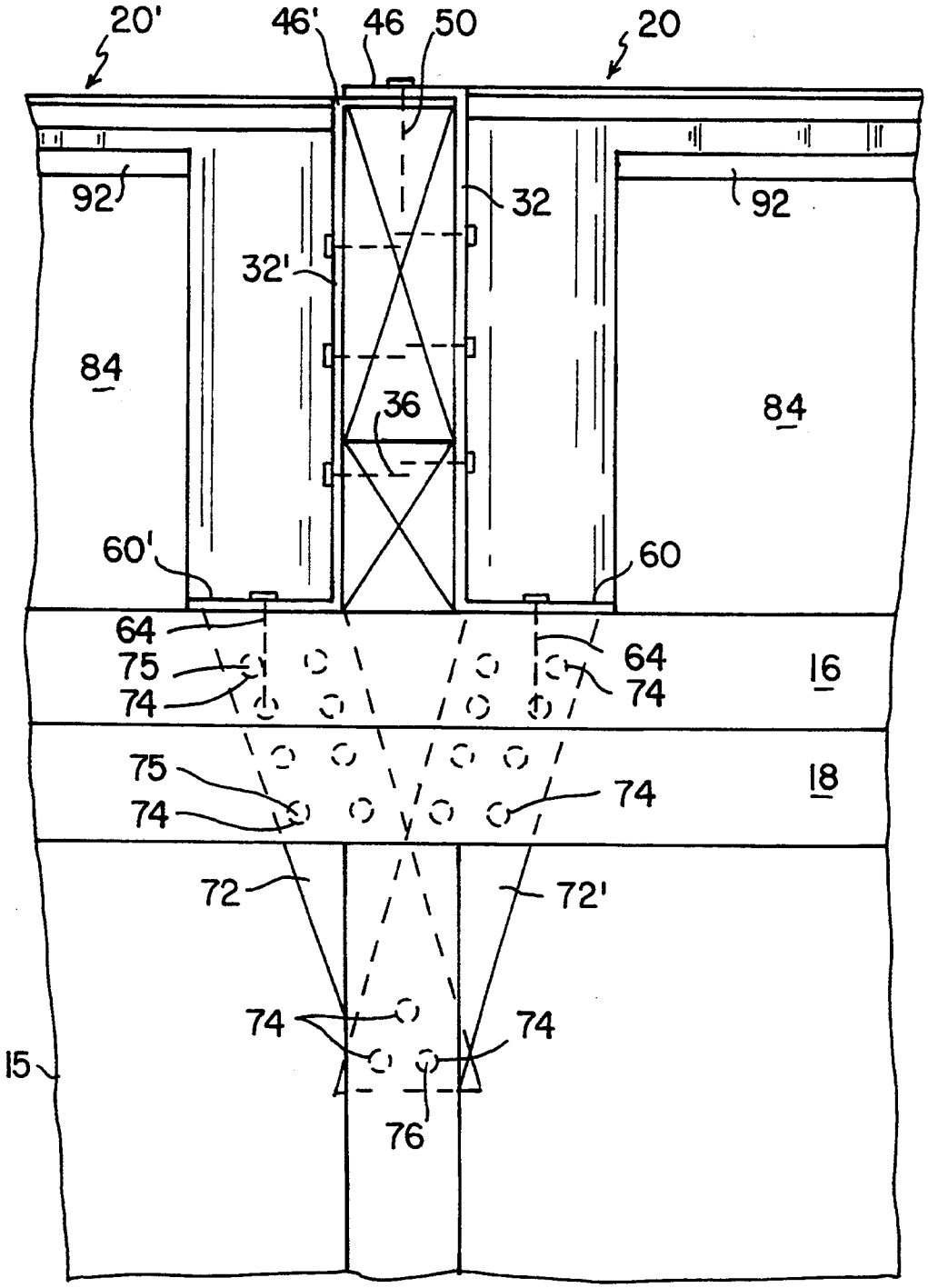
FIG. 4 is a rear elevation view illustrating the interconnections between elements of the system.

First and second stud tie down straps 72, 72′ are joined to the lower side 28 of the face plate 22 and extend downwardly and outwardly from the lower side 28 of the face plate 22 in substantially the same plane as the face plate 22. With reference to FIG. 4, each stud tie down strap 72, 72′ includes a plurality of openings 74 through which strap connectors 75 and stud tie down connectors 76 are inserted. Each stud tie down strap 72, 72′ is a quadrilateral member having an upper side defined by the lower side 28 of the face plate 22, a substantially parallel lower edge 78, a first side edge 80, and a second side edge 82 substantially parallel to the first side edge.

As seen in FIG. 5, back plate 84 is joined to lower side 28 of the face plate 22 and extends from the lower side 28 in a plane which forms an acute angle between the back plate 84 and the face plate 22. Referring also to FIG. 3, the back plate is a quadrilateral member with a lower side defined by the lower side 28 of the face plate 22, an upper edge 86 substantially parallel to the lower side 28, a first side edge 88 and a second side edge 90. The upper edge 86 forms a lip 92 to hold batt insulation down.

The first step in constructing a roof in accordance with the present invention is to position a first roof truss having cords 12, 13 in place above the top member 16 of the top plate, with the plywood sheathing 15 outwardly of the top member 16, bottom member 18 and the studs 14. The first apparatus 20 is then positioned on the top member 16 of the top plate tight against the truss chord 12 and sheathing 15 as illustrated in FIG. 1. The first truss chord flange 32 is secured to the top truss chord 12 using truss chord flange connectors 36. The first top plate tab 60 is connected to at least the top member 16 of the top plate using top plate connectors 64.

A second roof truss having cords 12′, 13′ is then positioned on the top member 16 of the top plate adjacent to the second edge 30′ of the first apparatus 20. A second apparatus 20′ is then positioned on the top member 16 of the top plate adjacent to the truss chord 12′ as illustrated in FIG. 1. The first top truss chord web 46 of the second apparatus 20′ directly overlies the second top truss chord web 46′ of the first apparatus 20 such that the openings 48 are in alignment. Truss chord connectors 50 are driven through the openings 48 of the first and second truss chord webs 46, 46′, thereby securing the truss chord webs 46, 46′ to the top truss chord 12 and interlocking the first apparatus 20 with the second apparatus 20′. In one embodiment, the truss chord webs 46, 46′ are movable or bendable to better facilitate locating the top of the top truss chord 12 below the webs 46, 46′. After the top truss chord 12 is positioned below the webs 46, 46′, they can be bent downwardly to overlie the tops of the particular top truss chords 12.

The second truss chord flange 32′ of the first apparatus 20 is secured to the truss chord 12′ and the second top plate tab 60′ of the first apparatus 20 is secured to the top member 16 of the top plate. The first truss chord flange 32 of the second apparatus 20′ is secured to the top truss chord 12′ and the first top plate tab 60 of the second apparatus is secured to the top member 16 of the top plate. The second stud tie down strap 72′ of the first apparatus 20 and the first stud tie down strap 72 of the second apparatus 20′, which overlap, are then connected through the sheathing 15 to the top member 16 and bottom member 18 of the top plate and to the stud 14′. The lowermost openings 74 of the first stud tie down strap 72 of the second apparatus 20′ are directly aligned with the lowermost openings 74 of the second stud tie down strap 72′ of the first apparatus 20. Stud tie down connectors 76 are driven through the openings 74 of the first and second stud tie down straps 72, 72′ thereby securing the stud tie down straps through the sheathing 15 to one of the studs 14 and further interlocking the first apparatus 20 with the second apparatus 20′.

It should be appreciated that the tie down straps 72 can be of any suitable length. In one embodiment, the length of tie down straps 72 is almost twice the height of the face plate 22 whereby each tie down strap 72 has sufficient length to extend past the double thickness top plate and be desirably positioned in an overlapping relationship with another tie down strap 72 for connection to a stud 14 and/or sheathing 15.

It should also be understood that the tie down straps 72 could be connected to only the sheathing 15 instead of one or more of the studs 14 and sheathing 15. The location or spacing between studs 14 will affect this connection. That is, the studs 14 need not be placed or located as illustrated in the figures, but may be positioned such that the tie down straps overlie only the sheathing 15 and not the studs 14.

The process detailed above is repeated, successively interposing roof trusses with apparatuses 20, resulting in an integrally interconnected building structure. The disclosed system 10 provides multiple functions associated with the construction of the roof structure. First, as noted, the system 10 provides an integrally interconnected building structure wherein top truss chord members 12 are connected horizontally to one another and vertically to the framing of the building. Furthermore, the apparatuses 20, which interconnect each truss, are also interconnected. This results in a building structure which exhibits structural integrity in the horizontal dimension and the vertical dimension. This aspect of the invention is particularly important in geographic regions prone to high winds, such as hurricanes, seismic shocks, or other natural stresses.

Each apparatus, 20, also acts as a structural spacer typically called bridging to precisely position the next roof truss without resorting to measuring instruments, thereby saving time and construction expense. The perforated or ventilated face plate 22 allows ventilating air to enter and exit the attic space. The back plate 84 acts as an insulation retainer to prevent insulation 100 from moving horizontally into the face plate 22, thereby blocking the ventilation holes 24. Additionally, the back plate also keeps insulation 100 from rising upward in the vertical direction thereby preventing the blocking of air space (S) (FIG. 5). The combination of interconnected metal apparatuses may also act as an antenna in which a conducting wire is connected to one of the apparatuses and extends to a receiver, such as a television or radio.

The disclosed embodiment of the present invention is manufactured from galvanized steel, however it will be appreciated that a wide range of materials could be used provided the materials exhibit sufficient strength and ductility. The apparatus 20 is formed by first stamping a single piece from a sheet of light gauge steel using a pattern. An operator then uses a brake and/or clamps to form the appropriate bends in the stamped piece.

What is claimed is:

1. A system for providing multiple functions in combination with building members including a truss having a number of chords including first and second chords, a plurality of vertically extending studs including first and second studs covered with sheathing and a top plate having at least one of an upper member and a lower member, comprising:

a first apparatus and a second apparatus, each of which includes:

a face plate having ventilation holes through which air is able to pass, said face plate having first and second ends and bottom and top sides;

first and second side truss chord flanges joined to said first and second ends, respectively, of said face plate;

first and second top truss chord webs joined to said first and second side truss chord flanges, respectively;

first and second top plate tabs joined to said first and second side truss chord flanges, respectively;

first and second stud tie down straps extending from said face plate;

at least a first top truss chord connector; and at least a first stud strap connector wherein said first top truss chord connector directly interconnects said second top truss chord web of said first apparatus and said first top truss chord web of said second apparatus to the second truss chord and said first stud strap connector directly interconnects said second stud strap of said first apparatus and said first stud strap of said second apparatus to at least one of the top plate upper member, the top plate lower member and the second stud whereby structural integrity is provided among the building trusses, top plate and studs using the direct connections between said first and second apparatuses.

2. A system, as claimed in claim 1, wherein:

each of said first and second apparatuses further includes a back plate joined to said face plate for preventing insulation from blocking said ventilation holes and in which said back plate has a top edge.

3. An apparatus, as claimed in claim 2, wherein:

said back plate is joined to said bottom side of said face plate.

4. A system, as claimed in claim 2, wherein:

said back plate includes a lip extending from said top edge thereof in which said lip is engagable with insulation to reduce uplifting of the insulation.

5. A system, as claimed in claim 1, wherein:

said face plate includes a rib extending from said top side thereof, said rib having a width less than a length of each of said first and second top truss chord webs with each of said web lengths extending in a direction along lengths of the first and second truss chords.

6. A system, as claimed in claim 1, wherein:

said second top truss chord web of said first apparatus and said first top truss chord web of said second apparatus are disposed in an overlapping relationship with said first top truss chord connector located through each of them for connection to the second truss chord.

7. A system, as claimed in claim 1, wherein:

said second stud tie down strap of said first apparatus and said first stud tie down strap of said second apparatus are disposed in an overlapping relationship with said first stud tie down strap connector located through each of them for connection to the second stud.

8. A system, as claimed in claim 1, wherein:

each of said first and second apparatuses is an integral unitary member.

9. A system, as claimed in claim 1, wherein:

each of said first and second stud tie down straps of each of said first and second apparatuses is disposed at an oblique angle relative to said face plates.

10. A system, as claimed in claim 1, wherein:

at least said first top truss chord web of said second apparatus is movable for connection to the second truss chord.

11. A system, as claimed in claim 3, wherein:

a juncture between said face plate and said back plate defines an acute angle.

12. A system, as claimed in claim 2, wherein:

said face plate has a length and said back plate has a length with said length of said face plate being greater than said length of said back plate.

13. A system, as claimed in claim 1, wherein:

said face plate is formed by stamping and said first and second side truss chord flanges are formed by bending.

14. A system, as claimed in claim 5, wherein:

said width of said rib is less than one-half of each of said web lengths.

15. A system, as claimed in claim 1, wherein:

each of said first and second side truss chord flanges of said first apparatus has a width and each of said first and second top truss chord webs and said first and second top plate tabs of said first apparatus has a length and in which said widths and lengths are substantially the same.

16. An apparatus for providing multiple functions in combination with building members including a truss having a number of chords including first and second chords, a plurality of vertically extending studs including first and second studs covered by sheathing and a top plate having at least one of an upper member and a lower member, comprising:

a face plate having first and second ends and bottom and top sides and with ventilation holes for permitting the passage of air;

first and second side truss chord flanges joined to said first and second ends, respectively, of said face plate;

first and second top truss chord webs joined to said first and second side truss chord flanges, respectively;

first and second stud straps joined to said face plate; and a back plate joined to said face plate for preventing insulation from blocking said ventilation holes and having a top edge;

wherein said face plate, said back plate, said first and second side truss chord flanges, said first and second top truss chord webs and said first and second top plate tabs are integral parts of a unitary member.

17. An apparatus, as claimed in claim 16, wherein:

said back plate includes a lip extending from said top edge thereof in which said lip is engagable with insulation to reduce uplifting of the insulation.

18. An apparatus, as claimed in claim 16, wherein:

said face plate includes a rib extending from said top edge thereof, said rib having a width less than a length of each of said first and second top truss chord webs with each of said web lengths extending in a direction along lengths of the first and second truss chords.

19. An apparatus, as claimed in claim 16, wherein:

each of said first and second stud straps is disposed at an oblique angle relative to said face plate.

* * * * *